United States Patent [19]

Abe et al.

[11] Patent Number: 4,921,154

[45] Date of Patent: May 1, 1990

[54] SEPARATING DEVICE IN AN AUTOMATIC STAMPING MACHINE

[75] Inventors: Sadaji Abe, Koshigaya; Sakae Suzuki, Sohka, both of Japan

[73] Assignee: Sugano Mfg. Co., Ltd., Tokyo, Japan

[21] Appl. No.: 173,872

[22] Filed: Mar. 28, 1988

Related U.S. Application Data

[63] Continuation-in-part of Ser. No. 118,762, Nov. 9, 1987, abandoned, which is a continuation of Ser. No. 7,487, Jan. 28, 1987, abandoned, which is a continuation of Ser. No. 668,013, Nov. 3, 1984, abandoned.

[30] Foreign Application Priority Data

Nov. 17, 1983 [JP] Japan ..... 58-216916
Jun. 30, 1984 [JP] Japan ..... 59-136234

[51] Int. Cl.[5] ..... B21K 5/20; B26F 3/02

[52] U.S. Cl. ..... 225/97; 76/107.8; 83/620; 83/686; 83/690

[58] Field of Search ..... 493/82, 83, 342, 373; 76/107 R, 107 C; 225/97; 83/97, 164, 103, 690, 691, 620, 686, 687

[56] References Cited

U.S. PATENT DOCUMENTS

| | | | |
|---|---|---|---|
| 2,175,130 | 10/1939 | Wilkie | 76/107 R |
| 2,759,402 | 8/1956 | Jedlick | 493/342 |
| 3,357,322 | 12/1967 | Gill | 493/82 |
| 3,658,220 | 4/1972 | Norton | 493/342 X |
| 3,863,550 | 2/1975 | Sarka et al. | 83/694 X |
| 4,109,842 | 8/1978 | Aquilla | 493/373 X |
| 4,235,583 | 11/1980 | Reed | 76/107 R |
| 4,371,369 | 2/1983 | Wright, III | 493/83 X |
| 4,665,779 | 5/1987 | Ratz | 76/107 R |

FOREIGN PATENT DOCUMENTS

| | | | |
|---|---|---|---|
| 189918 | 6/1937 | Switzerland | 76/107 R |

*Primary Examiner*—Frank T. Yost
*Assistant Examiner*—Rinaldo Rada
*Attorney, Agent, or Firm*—Price, Heneveld, Cooper, DeWitt & Litton

[57] ABSTRACT

An automatic machine for die cutting and creasing paperboard and similar paper materials, in sheet or continuous web form, into shaped package blanks and the like has a separation station at which the shaped blanks are separated from the waste portions of the sheet or web. The blanks are cut into the paperboard stock leaving just enough material, termed nicks, to hold the blanks and waste material together for transfer as a unit to a separation station. The machine is so designed that the male and female dies are simultaneously formed by cutting both from a single panel of plywood and even though the portions remaining between the individual die openings of the female ones of the dies are too narrow and weak to withstand the impact incident to the separation operation, are reinforced to provide the necessary strength by bonding a strip of creasing die to the lower face of the portions needing reinforcement.

10 Claims, 7 Drawing Sheets

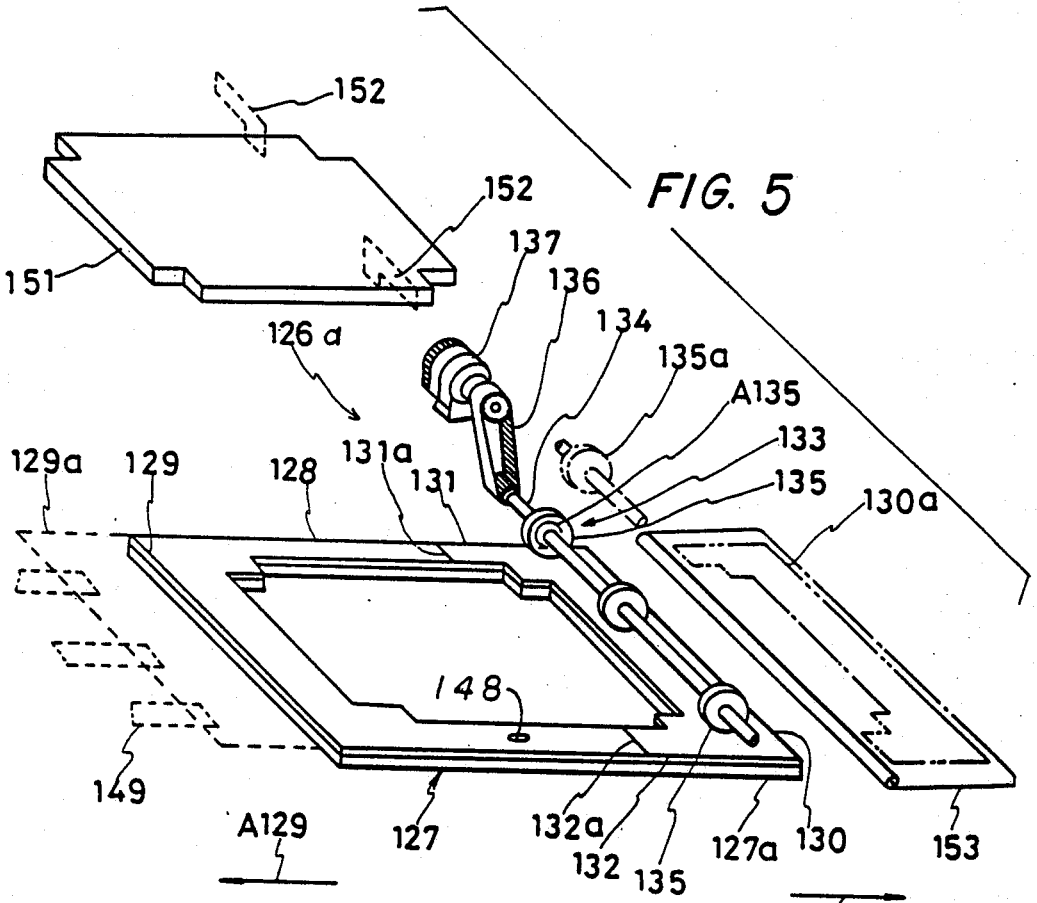
FIG. 5
FIG. 6
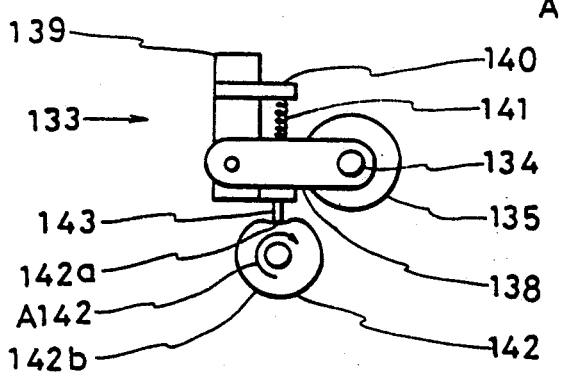

FIG. 15
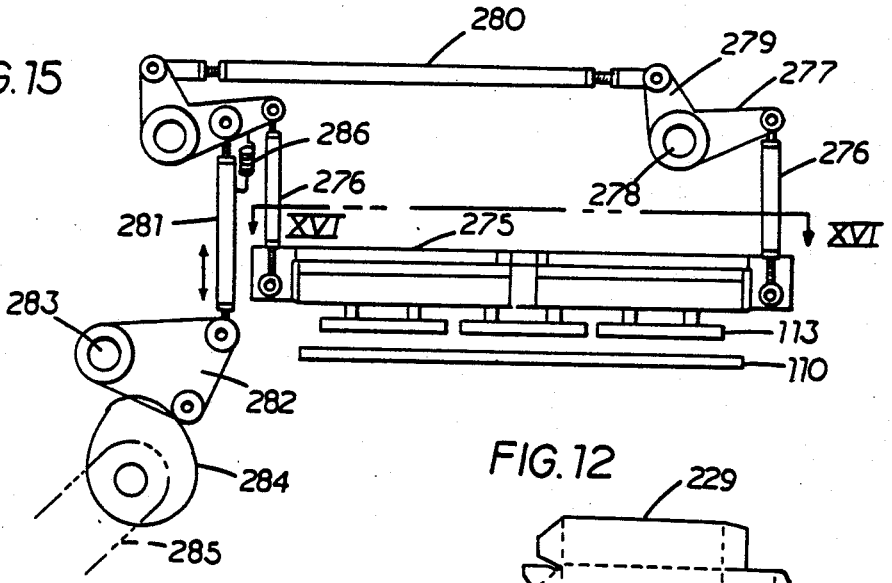
FIG. 12
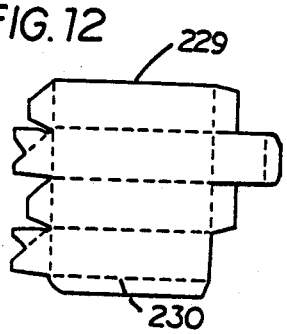
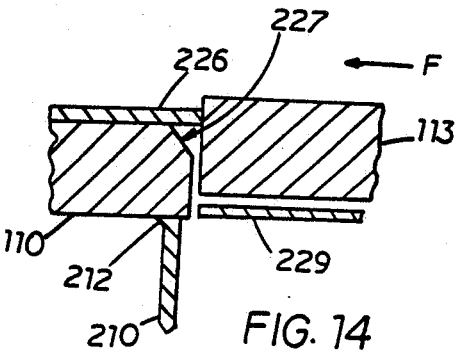
FIG. 14
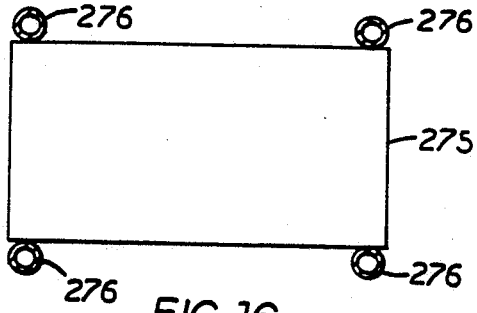
FIG. 16
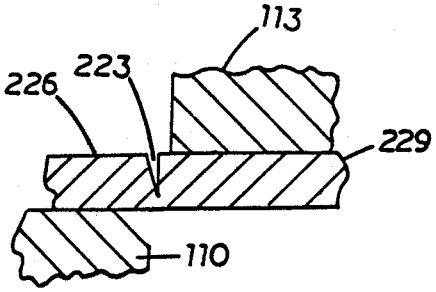
FIG 14A
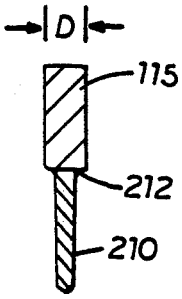
FIG. 13
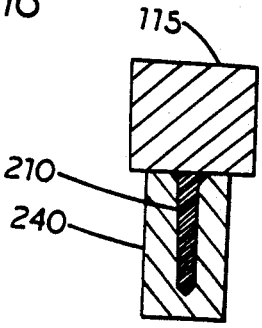
FIG 13A

SEPARATING DEVICE IN AN AUTOMATIC STAMPING MACHINE

FIELD OF THE INVENTION

This application is a continuation-in-part of presently pending U.S. patent application Ser. No. 118,762 filed November 9, 1987, entitled SEPARATING DEVICE IN AN AUTOMATIC STAMPING MACHINE, now abandoned, which application is a continuation of U.S. patent application Ser. No. 007,487 filed January 28, 1987 entitled SEPARATING DEVICE IN AN AUTOMATIC STAMPING MACHINE, now abandoned, which application is a contination of U.S. patent application Ser. No. 668,013, filed November 3, 1984, entitled SEPARATING DEVICE IN AN AUTOMATIC STAMPING MACHINE, now abandoned.

The present invention relates to a separating device in an automatic stamping machine (commercially known as cutter-creaser), and more particularly, to a separating device in an automatic stamping machine for separating the cut paper sheet into the shaped section or sections and a waste section and smoothly removing the waste section remaining on a lower or female die of the separating device.

In general, paper products such as boxes or cartons of paperboard or corrugated cardboard boxes are manufactured by stamping, that is rule die cutting, a paper sheet into one or more pieces of specific shape by means of an automatic die cutting and creasing machine, and then the shaped pieces resulting from the cutting are separated from the waste portion of the paper stock, in some cases, folding the separated paper pieces.

Heretofore, in an automatic stamping machine of the above-described type as shown in FIG. 8, paper stock 1 in sheet form is fed to a reciprocating cutter-creaser 3 by means of a feeder 2. The cutter-creaser cuts slits between the shaped section or sections 4 and a waste section 5. However, the paper sheet 1 remains intact because some connecting portions or bridges are retained along the cutting slits. At the same time, creases may be formed in the paper where the paper article is to be folded. Thereafter, the same paper sheet 1 is conveyed to a separating device 6, in which the shaped section or sections 4 and the waste section 5 are separated from each other along the slits cut in the cutting operation. The shaped section 4 is deposited in an accumulating device 7, and the waste section 5 is conveyed to a waste receiver 5*a* by means of a belt conveyor 8. The separating device 6 includes a lower or female die (not shown) for supporting the waste section 5 and an upper die 9 for pressing the shaped section 4 out of the paper sheet. For this purpose, the lower die has one or more openings through which the shaped sections are pressed by the upper or male die. To accomplish this, the opening in the lower die must have the same shape as the portion or article to be separated from the paper stock and this opening must be only slightly larger than the portion being separated. Also, the male die member must have the same shape as the opening in the lower die and be able to pass through the opening in the lower die with only a minimal clearance. For this purpose, it has long been standard practice to form the male or upper die by providing an array of a large number of pins arranged so as to have nearly the same shape and forming an outline of the same size as the shaped section 4. The paper sheet 1 is conveyed along the upper surface of the lower die and positioned with the shaped section 4 in register with the stamping hole of the lower die. The shaped section contacting portion 9*a* of the upper die then forces the shaped section 4 through the stamping hole or die opening in the lower die effecting its separation from the waste section 5.

However, in this separating device 6, each time the shape of the product is changed, the pins on the upper die must be removed and remounted in a new pattern (hereinafter called "pin registering operations"). In these pin registering operations, the number of pins involved is large and the pins must be positioned precisely along the contour of the shaped products. Thus, the change over from one product to another is troublesome and time consuming. Therefore, the operation of the machine must be interrupted for a long period and hence its working efficiency is bad. Moreover, in those cases in which the quantity of products having the same shape is small, the usage of each upper die and each lower die combination is also small, hence such operations are economically unprofitable. In addition, since the shaped section 4 falls nearly in a horizontal attitude for accumulation in the accumulating device 7 while being subjected to air resistance the edges 4*a* of the shaped sections 4 become misaligned, and so, the accumulated shaped sections 4 are inconvenient to handle. Especially, in the case of small, shaped sections 4, the above-mentioned disadvantage is remarkable.

As the waste section 5 is a portion to be thrown away, from the view point of effective utilization of the paper sheet, the waste section 5 is designed to have minimum area. As a result, the trailing edge portion of the waste section 5 is small in area and is weak and lacks rigidity. Accordingly, if the waste section 5 resting on a lower die 10 of the separating device 6 is moved toward the belt conveyor 8 while the front end portion of the waste section 5 is supported by means of a nipping device (not shown), then the rear end portion of the waste section may bend by its own weight and, thus, changes from the state 5A in FIG. 9 to the state 5B. Thus, the central part of the rear end portion will be caught by a thick portion 10*a* of the lower die. Under such a condition, if the waste section 5 is further moved in the same direction, then the rear end portion of the waste section 5 will be torn off, and either the rear end portion remains on the lower die 10 or falls into the accumulating device for the shaped sections 4.

It is, therefore, an object of this invention to provide a separating die having upper and lower dies which are simultaneously formed by precise cutting means, such as laser cutting from a panel of wood veneer and, thereby, have minimum clearance between them.

It is a further object of the invention to so design the lower or female die that the strength and rigidity of the lower die is such that the width of the waste strips between the openings created by removal of the shaped products and at the die's periphery are substantially narrower than heretofore has been possible unless the die is made as a heavy cast or welded metal member.

It is another object of this invention to provide a means of reinforcing the narrow, waste portion supporting sections of the female or lower die such that the width of such portions can be substantially reduced while still rigidly supported to withstand the impact forces incident of high production operation.

It is further a objective of this invention to accomplish this goal while using a wood laminate or veneer panel for the upper and lower dies thereby reducing the manufacturing costs and weight of these dies and making it possible to use advanced techniques in their manufacture.

It is a still further objective of this invention to provide a means and technique for creating such dies that permit the dies to be reinforced by a commonly available material which can be easily formed to produce complex and intricate shapes by readily available techniques and equipment.

An additional objective of the invention is to provide a die construction capable of high speed production using the equipment and technical skills already available in even relatively small paper product cutting-creasing operations whereby such operations are rendered capable of making their own dies.

Another aspect of this invention is increasing the equipment's productivity. This is accomplished by increasing the number of separation cycles completed per minute. The invention accomplishes this by increasing the proportion of each separation cycle during which the paper stock can be moved without interference from either the cutter-creaser die or the separation die. This increase results from maintaining the dies parallel to the paper stock, eliminating the conventional time lag between that at which release of the stock is initiated and that at which total release of the stock is completed.

It is a still further object of the invention to provide a separation die having these advantages which is substantially less complicated and expensive to make and, thereby, economically feasible for use with products having only limited demand.

Another object of the present invention is to provide a separating device in an automatic stamping machine, in which misalignment of the edges of shaped sections accumulated within an accumulating device can be eliminated.

Still another object of the present invention is to provide a separating device in an automatic stamping machine, in which a waste section remaining on a lower die of the separating device can be smoothly removed.

A paper sheet fed onto the female die after having been stamped or cut by a cutting device into a shaped section and a waste section with minimal connecting portions remaining therebetween, has its shaped section separated by pressing the shaped section through the opening in the female or lower die by the male die. The separated shaped section is made to fall between guide plates on the lower peripheral surface of the female die. Cutting slits are formed in the waste section by waste tail cutting blades provided in the path of the waste section, and the waste section is severed along the cutting slits by a waste tail separating device provided at a rear portion of the female die and is thereby removed from the top of the female die.

The above-mentioned and other features and objects of the present invention will become more apparent by reference to the following description of preferred embodiments of the invention taken in conjunction with the accompanying drawings, wherein:

BRIEF DESCRIPTION OF THE DRAWINGS

FIG. 5 is a schematic perspective view showing a portion of a separating device according to another preferred embodiment of the present invention;

FIG. 6 is an enlarged front view of an essential part of the separating device shown in FIG. 5;

FIG. 12 is plan view of one of the shaped portions after separation from the original sheet of paper stock;

FIG. 13 is an enlarged sectional view of one of the narrow portions separating the openings in the lower die member;

FIG. 13A illustrates a modification of the lower die when additional guidance is needed for the separated portions;

FIG. 14 is an enlarged fragmentary sectional view of the upper and lower dies as related at the time of separation of the shaped portion from the waste portion of the sheet of paper stock;

FIG. 14A is a further enlarged, fragmentary section view similar to FIG. 14 illustrating the situation just as the upper die contacts the paper stock as it descends;

FIG. 15 is a somewhat schematic illustration of the mechanism for vertically reciprocating the upper die member; and FIG. 16 is a sectional view taken along the plane XVI—XVI of FIG. 15.

DESCRIPTION OF THE PREFERRED EMBODIMENT

Figure 1:
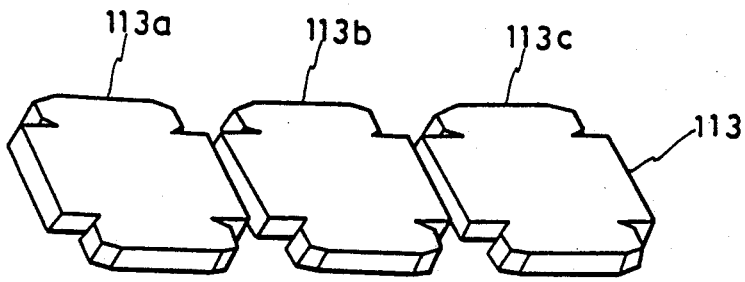
FIG. 1 is a perspective view of a male die to be used in a separating device according to one preferred embodiment of the invention.
Figure 2:
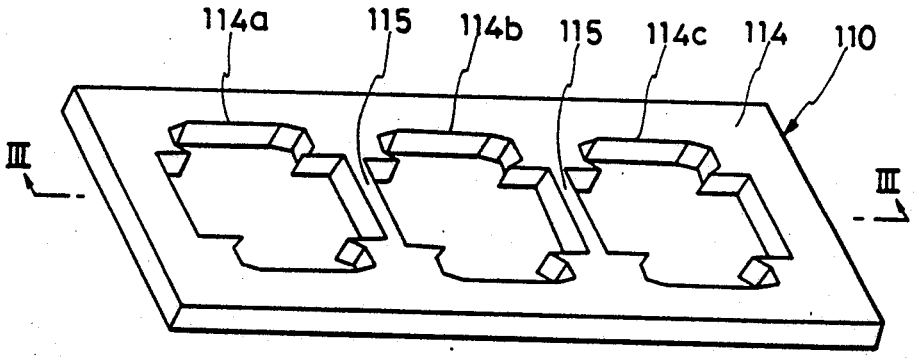
FIG. 2 is a perspective view of a female die to be used in the same separating device.
Figure 3:
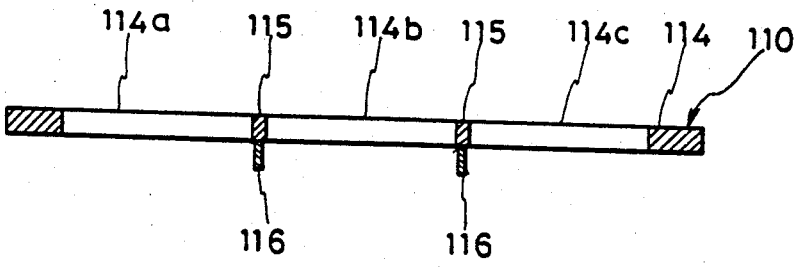
FIG. 3 is a sectional view taken along plane III—III of FIG. 2 as viewed in the direction of arrows.

First, description will be made of a separating device for separating the shaped sections from the waste portion of the paper stock according to a first preferred embodiment of the present invention with reference to FIGS. 1-3. A single panel 110 of a suitable material, namely wood veneer, of a size to seat in and to be firmly held by the walls of the opening 200 (FIG. 4) in the stationary frame or mounting table 117 of the separation station 126 of the machine. The panel's size is such as to prevent movement within the opening 200 in any direction with respect to the frame and its top surface is flush with that of the frame to facilitate movement of the paper stock over it. A suitable material for the panel 110 is a sheet of ¾ inch (19 mm) wood veneer. If a wood veneer stock is used which is thinner than the depth of the recess in the frame, it will be necessary to support the entire periphery of the panel 110 on a shim of a thickness such that the top of the panel is flush with the surface of the frame.

By means of a laser beam, the panel is cut to form a plurality of openings 114*a, b* and *c* through it of the size and shape of the articles which have been cut in the sheet of paper stock before the sheet is delivered to the separation or stamping station 126. The openings 114 are separated by narrow boundary portions or strips 115 of the plywood panel which are designed to be as narrow as possible consistent with the structural integrity of the lower die panel. The portions of the panel which are severed from the panel in the cutting operation become the male stamps or upper dies 113*a, b* and *c*, respectively, which will be used to pass through the openings 114*a, b* and *c*, respectively, in the lower die from which they were removed for the purpose of separating the shaped sections or articles from the waste portion of the paper stock. Thus, as will be see in FIGS. 1 and 2, the portions of the veneer panel 110 severed from the panel by the cutting process form the male separation dies 113*a, b* and *c*, leaving the remainder of the panel 110 as a female die plate having the openings 114*a, b* and *c*. The simultaneous creation of both the male and female die members is possible because cutting means such as a laser beam remove very little material, thus creating only a very narrow slit between the die portions. Also, this technique is capable of accurately cutting very intricate and complex shapes. It has the advantage of always producing a male die member which will pass through the opening in the female die with minimal clearance and without interference between the dies.

To obtain maximum efficiency from a machine of this type, it is very important that it be capable of making maximum use of the paper stock it processes. It is also important to the efficiency of the equipment that its operating cycle be as short as possible. These two requirements, particularly the first one, impose load factors on the female die member which heretofore could not be tolerated, unless the dies were made by the expensive technique of being cast as one or substantially one piece from a suitable material such as steel or the spacing between the openings through the female die was substantially wider than is desirable, if maximum use of the paper stock is to be made.

Maximum usage of the paper stock requires the width of the stock be such that the boundary or waste portions 120*a* and waste sections 226 (FIG. 11) remaining after separation of the usable product portion to be as narrow as possible. In the ideal die cutting operation, the waste portion of the stock consists of one or more long, narrow strips between the separated portions and a narrow strip-like border. In modern paper product designs these boundary portions can extend the full length or width of the paper stock or panel 111*a* (FIGS. 10 and 11). These waste strips or boundary portions must be positively supported during the separation or stamping operation. Failure to properly support the waste portion of the stock may and frequently does result in improper separation, such as incomplete severance, tearing of the articles or of the waste stock. Tearing of the waste stock can cause serious problems, such as imcomplete removal or becoming entangled in the stacks of separated articles. This can require machine shutdown or operation at a substantially decreased rate. This problem does not occur in the cutting operation because there are no openings in the lower die in the cutting station.

Heretofore, these narrow portions of the female die have required the female die to be made as a metal casting, particularly if the configuration of the strip was integrate as would be the case of the strip 226 illustrated in FIGS. 10 and 11. Such castings are both heavy and expensive to manufacture, thus, limiting their use to situations involving high volume.

It was discovered that the lower or female die panel can be fabricated from 19 mm or ¾ inch thick plywood which is then reinforced from below using steel creasing rule stock also known as nicking blades, of standard cross section, such as 1.5 to 2 mm by 23.0 or 23.8 mm. Either creasing or cutting rule stock will provide the necessary support, the only difference between these two types of stock being that only the cutting stock has a sharpened edge, unnecessary for reinforcement purposes making creaser stock the preferred material. Thus, a T-shaped section is created having a vertical leg 210 of the steel rule capped by the plywood 115 of the panel (FIG. 13). Using this technique, it has been possible to reduce the cross-section D of the plywood 115 to 7 mm and, in some cases, even to 5 mm (FIG. 13), a reduction in the waste portion of the paper stock never before accomplished unless a heavy, cast steel frame was used as the lower or female separation die.

Figure 11A:
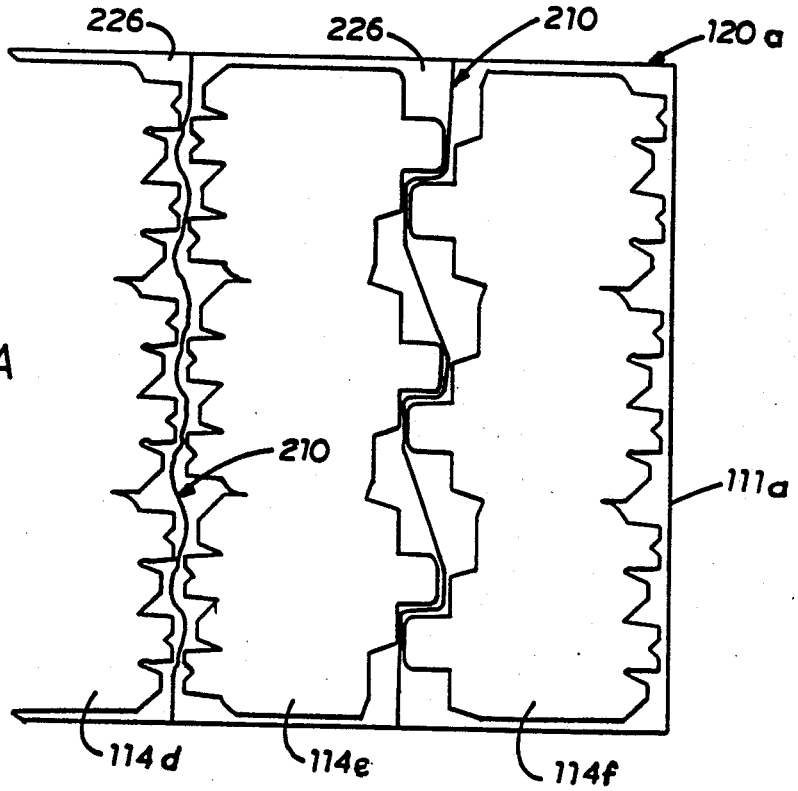
FIG. 11A illustrates a typical shape of the reinforcement member where it follows an irregular path between shaped sections, the same being shown as though it were on the surface rather than hidden below the surface.

The rule stock is a standard, commercially available product fabricated from soft steel. It is capable of being shaped into very intricate configurations by relatively simple equipment of the type normally available in any facility which fabricates paperboard or corrugated products from paperboard or corrugated paper sheet stock. It is capable of being bent to form corners of 90° or more with a minimum radius and thereby can be formed in a brake press to follow very intricate configurations. This is illustrated in FIG. 11A where the vertical leg consisting of the steel rule 210 is represented by a heavy line. In this forming procedure, the rule stock does not form wrinkles or assume a wavy configuration which would make it unsuitable for use in this invention. Where it has to be formed to traverse corners around which it cannot be bent it can be assembled from sections of the stock and welded at the joints thus formed. This procedure is to be avoided where possible because it is labor intensive. After shaping, the rule stock is bonded to the bottom surface of the panel by an adhesive 212. For the purpose of bonding the steel rule to the plywood, any suitable adhesive which will form a secure bond to both the metal and the wood can be used. An example of such an adhesive is Goseigomu-Setchaku zai G-17, which basically translates as "synthetic rubber adhesive G-17" manufactured by Konishi K. K. of Doshomachi, Higashi-ku, Osaka City, Japan.

It is important that the reinforcement member maintain contact with the plywood at all points along its length to assure a positive anchor to and support for the plywood panel. Also, this is necessary to assure a continuous bond between the panel and the reinforcement member. The steel rule is particularly suitable for this purpose because of the ease with which it can be shaped. The combination of the plywood panel and the steel rule reinforcement member, so bonded, creates a T-section of substantial strength in which the two components cooperate to provide a rigid support for the paper stock being treated. This structural section cannot be formed from an all metal stock of T-shape because it could not be formed into the necessary complex configurations. Further, the horizontal leg of the T-shape frequently has to vary through a wide range of widths, a requirement T-shaped stock cannot accommodate.

Figure 4:
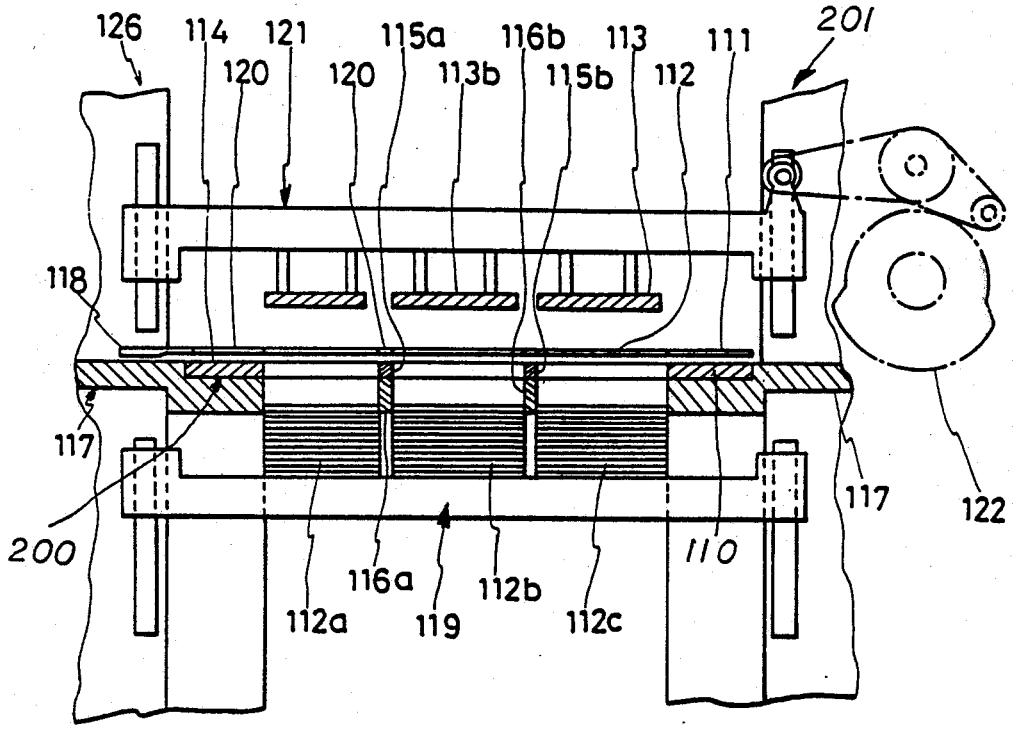
FIG. 4 is a schematic sectional view illustrating the entire separating device with the male and female dies shown in FIGS. 1 to 3 mounted therein, the paper stock being moved right to left as shown in the view.

FIG. 4 illustrates the above described male die 113 and female die 114 mounted on the frame 201 of a separating station 126 in an automatic stamping or cutting and separating machine. In this figure, reference numeral 117 designates a mounting table for the female die 114. Numeral 118 designates a conveying device having a nipping member for gripping the paper sheet 111. Numeral 119 designates an accumulator for the separated shaped sections 112. Numeral 120 identifies waste sections of the paper sheet 111. Above the female die 114, the header 121 supports the male die members 113 for reciprocal vertical movement. The cam mechanism 122 vertically reciprocates the header 121. The cam 122 and cam follower illustrated in FIG. 4 are conventional and, in machines incorporating this invention, are replaced by the mechanism illustrated in FIG. 15.

Figure 8:
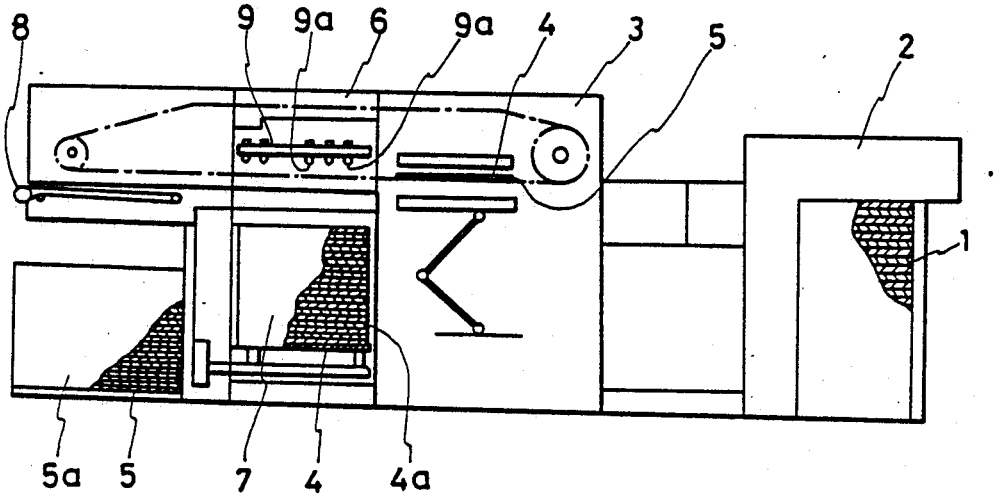
FIG. 8 (PRIOR ART)
FIG. 8 is a schematic front view, partly in cross-section, of an automatic stamping machine of the prior art.

Prior to introduction into the separation station 126, the sheet of paper stock 111 has been prepared at a cutting and creasing station such as the cutter-creaser station 3 shown in FIG. 8. At that station, each sheet of paper stock is die cut to form the shaped sections the creation of which is the purpose of the equipment. This is done by a vertically reciprocated cutting and creasing die equipped with cutting and creasing rule which has been formed to produce the pattern or product shape required. The cutting blades entirely sever the shaped sections from the waste portions except for a limited number of narrow connecting bridges or nicks 223 which remain partially uncut (FIG. 14A) so that the shaped sections will remain connected to the waste portions, permitting the sheet to be transported intact from the cutting and creasing station to the separation station. The number and location of these bridges is important to the operation of the machine as will be understood from studying FIGS. 10 and 10A.

A die cut sheet of paper stock 111*a* is illustrated in FIG. 10 in the condition it is transported from the cutting station to the separation station 126 where the shaped sections 229 (FIG. 12) are separated from the sheet, leaving only the waste portion 120*a* with the openings 114*d, e,* and *f* (FIG. 11). The direction of movement between and through the stations is indicated by the arrow A. The shaped sections 229 are connected to the waste sections 226 by the bridges or nicks identified by the numerals 223. When two or more shaped sections are located in side-by-side relationship without a waste portion between them as illustrated in FIG. 10, it is important that the bridges 223 are all located at the front and rear of the shaped sections with respect to the direction of movement of the paper stock from the cutting and creasing station to the separation station, as indicated by the arrow A. Without a waste section between shaped portions, there would be nothing at the separation station to rupture any bridges which are left between abutting shaped sections.

The bridges 223 are so narrow they cannot be illustrated in normal scale with the remainder of the paper stock and, in fact, are normally created by nicking the cutter blades with a suitable tool to form a notch of less than 1.0 mm in length at which the blade still cuts through a half or more of the thickness of the paper (FIG. 14A). This, however, leaves enough paper to provide a positive connection capable of transmitting the tension loads resulting from the sheet being gripped by the nipping device or gripper and transported to the separation station by the conveying device 118. Thus, these bridges are all aligned in the direction in which the sheet is transported between stations. The broken lines 230 indicate creases along which the shaped sections will be folded to form the final product such as a carton.

The conveying device 118 places the cut sheet stock on the separation station in accurate register with the openings 114*a, b,* and *c* or their equivalents.

Subsequently, the mounting table or header 121 is lowered by the actuation of the cam mechanism 122, to cause the male die portions 113*a*, 113*b* and 113*c* secured to the header 121 to strike the shaped sections 112*a*, 112*b* and 112*c* of the paper stock 111 (FIG. 4). The lower faces of the die portions 113*a, b* and *c* do not pass entirely through their respective die opening, stopping about 3 mm short of passing through (FIG. 14). This causes separation of the shaped sections 229 from the male die while the sections are still confined within the openings in the lower or female die. This helps to align them for the drop into the accumulator below.

The impact of the header severs the bridges 223 thereby separating the shaped sections from the waste portion. For this purpose, it is important that the header descend while maintaining a parallel relationship with the paper stock to facilitate a clean and complete rupture of the bridges. Because the gap between the upper and lower dies is quite narrow and the bridges are small, there is only a slight tendency for the upper die to pull the waste portions into the area between the male and female dies. It has been found that breaking the edge to form a small chamfer 227 (FIG. 14) at the upper edge of the die opening is significant in preventing the die cut portions from inadvertently becoming caught against the edge of the die opening during transport of the die cut sheet into the separation station. This can happen if the die cut portion does not remain aligned with the remainder of the sheet of paper stock. This chamfer only needs to be provided at the downstream edge of the die opening as indicated by arrow F indicating the direction of movement of the paper stock (FIG. 14).

The separated shaped sections, after separation, are accumulated on the top of the piles of such sections in the compartments of the accumulation device 119 provided below the separation die. Preferably, the sections accumulate on supports which retreat downwardly as the sections accumulate so as to maintain a short path between separation and accumulation. Thus, short guides 116, such as those shown in FIG. 3, can be used at a few points about the periphery of the separated shaped articles to keep them aligned. These can be the reinforcement members 116 or 210 described above and illustrated in FIGS. 3, 13 and 14 which will provide a reasonable degree guidance to the shaped sections especially in areas where the width of the waste portion is at or near minimum. However, if more control over the descent path of the shaped sections is desired where the width of the waste portion is significantly greater than that of the steel rule, the guides should be thicker than that provided by the reinforcement member. For this purpose, at such intervals as are necessary to guide the shaped sections, a thicker guide may be used. This can be provided by short blocks 240 acting as guides which are mounted on the steel rule reinforcement member 210. In areas of the die where no reinforcement of the plywood lower panel is necessary the guides 210 can be fabricated from creasing rule and placed immediately adjacent the opening, as suggested in FIG. 14. These guide blocks 240 may be fabricated to clamp over the depending portion of the reinforcement members and secured by friction alone or by suitable bonding to the vertical leg 210 of the reinforcement member (FIG. 13A). After separation of the shaped portions, the upper dies are withdrawn and the waste section 120 remaining on the female die 114 is conveyed to a waste receiver (not shown).

It is the necessity for moving the paper stock from one station to another and properly aligning it at the stations which controls the length of the operating cycle. In the case of both the cutter-creaser and the separator, it is essential that the paper stock remain stationary until the upper dies have positively released or separated from the paper stock. This is particularly a problem at the separation station because, unlike the cutter-creaser, the upper dies must pass through the opening in the lower die a sufficient distance to positively rupture all of the bridges or nicks connecting the shaped sections to the waste stock. Heretofore, equipment of this type raised and lowered the upper die by means which caused or permitted the upper die to descend and withdraw while assuming a position nonparallel to the lower die. This resulted in a significantly longer interval during which some portion of the upper die remained in position to interfere with movement of the paper stock. Thus, the mechanism for transferring the paper stock from one station to another had to remain idle until positive and total separation of the upper die from the paper stock had occurred.

This invention overcomes this by supporting the upper die on a mechanism which positively maintains the surface of the upper die which passes into the lower die parallel with the surface of the lower die. This is accomplished by mounting the upper die members 113 on a frame 275 which is supported adjacent each of its corners by rods 276 (FIG. 15). The upper ends of the rods are each connected to one end of a crank 277 mounted for pivotal movement on a shaft 278. Each of the cranks has a second arm 279. The second arms 279 of the cranks, adjacent one side of the frame 275 are connected by a connecting rod 280. An identical pair of cranks and a connecting rod are mounted on the same shafts 278 above the opposite corners of the frame 275 and with the cranks each connected to their supporting shafts all four cranks have positively synchronized operation. The cranks at one end of each side are connected by a rod 281 to a cam follower 282 mounted to pivot about stationary support shaft 283. The cam follower in turn rests on an eccentric cam 284 which is driven from a suitable power source by a chain 285. The cam 284 positively lifts the frame 275 and allows it to descend into stripping or separating position once during each revolution. To positively assure descent of the frame 275, springs 286 are provided to pull the arms 277 and, thus, the upper dies downwardly. It will be noted from FIG. 15 that the shape of the cam is such as to hold frame 275 in raised position a major portion of the cam's cycle and that the mechanism positively assures that all portions of the upper die rise and descend simultaneously while maintaining a parallel relationship to the lower die.

An identical mechanism or one accomplishing the same functional objective can be used to operate the cutter-creaser and will be synchronistically driven with it. This arrangement permits the paper stock transfer mechanism to initiate the movement of the stock substantially more quickly following the cutting-creasing and separation steps. This permits the total length of the cycle to be shortened without requiring any reduction in the length of the acceleration and deceleration periods which must be provided to permit the paper stock to be transferred from one station to the other and accurately positioned at each station. As a result of this, the invention makes it possible for the machine to cut and crease and strip or separate some 130 sheets of paper stock per minute. At the same time, it allows enough time in each cycle that the sheets can be transferred from the cutter-creaser station to the separation station without failure of the bridges or nicks left by the cutting blades even though the number and strength of the individual nicks has been reduced. The use of smaller and less numerous nicks also provides another improvement. Having less nicks and making each of them smaller reduces the total force which must be applied to rupture them. This in turn reduces the tendency for the strips of waste stock to be drawn into the opening in the lower die where they could interfere with the retraction of the upper die, a problem which can seriously impair the utility of high speed separation equipment.

According to the present invention, since a male die and a female die are formed by cutting from a single flat panel of wood veneer, the upper and lower dies can be manufactured simultaneously. Moreover, since an inexpensive flat panel of wood veneer is employed, the manufacture of both dies can be achieved easily, in less time and less expensively. In addition, replacement work for the dies also can be carried out easily in a short period of time as compared to the case in which replacement of the dies requires the location and mounting of a large number of pins. Further, the dies created by this invention are relatively lightweight compared to conventional cast metal dies or those utilizing the pins. This reduces momentum and inertia which not only require additional energy but are the cause of undesirable wear, noise and vibration.

Now, description will be made of a second preferred embodiment of the present invention, in which the separating station is provided with a waste tail separating device, with reference to FIGS. 5 to 7. FIG. 5 illustrates a separating device 126*a*, in which the lower die consists of a female die formed of a single flat plate or panel forming the lower die 127 in the above-described manner having the waste section 128 resting on it. A leading end portion 129 of this waste section 128 is illustrated in phantom is gripped by the nipping devices of a paper sheet conveying device 149. On the opposite sides 131 and 132 of the rear portion 130 of the waste section 128, cutting slits 131*a* and 132*a* are formed. These are arranged perpendicularly to the traveling direction of the nipping device and the waste paper material. A waste tail separating device 133 is mounted above the rear portion 130 of the waste section 128, that is, above the rear portion 127*a* of the lower die 127.

The waste tail separating device 133, as shown in FIGS. 5 and 6, has three rollers 135 spaced at equal intervals on a shaft 134. One end of the shaft 134 is coupled to an electric motor 137 by a belt 136. Further, the shaft 134 is connected to a bracket 139 by the vertically swingable lever 138. It is to be noted that, in FIG. 6, reference numeral 140 designates a support bracket for one end of a spring 141 the other end of which engages the lever 138. Numeral 142 designates a cam and numeral 143 designates a rod, one end of which contacts the cam 142 and the other end engages the lever 138.

Figure 7:
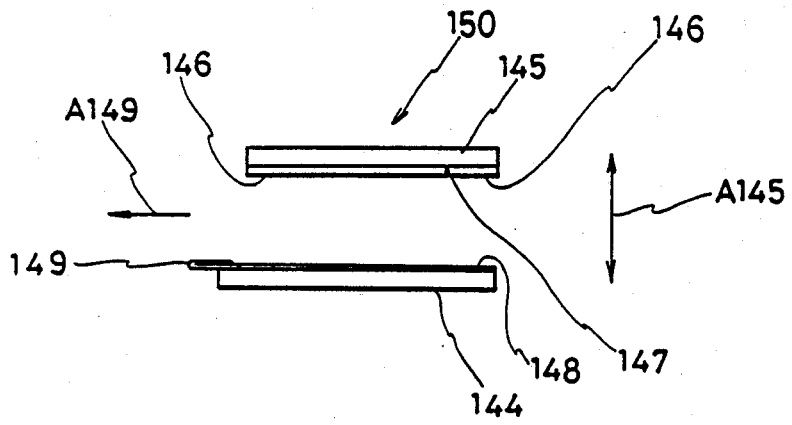
FIG. 7 is a side view showing an essential part of a cutting means incorporated into the separating device shown in FIG. 5.

FIG. 7 shows an essential part of a stamping device 150, in which a blade support 145, vertically movable in the directions of arrows A145, is provided above a stamping table 144. Cutting blades 146, normally in the form of rule dies, are provided on the lower surface of the blade support 145 and waste tail cutting blades 147 are provided in the rear portion of the same lower surface.

Now the operation of the second preferred embodiment will be explained. A paper sheet 148 is fed to the stamping device 150 and slits in the shape formed by the cutting blades 146 are cut between and to separate the shaped section from the waste section. At the same time, cutting slits 131*a* and 132*a* are formed in both side regions 131 and 132 of the rear portion 130 of the waste section by the waste tail cutting blades 147.

The paper sheet 148 is moved in the direction indicated by arrow A149 while gripped by the nipping devices 149. When the paper sheet 148 has been moved to a predetermined position in the separating device 126, the upper die 151 (FIG. 5) is abruptly lowered to impact the paper sheet 148 supported on the lower die 127 to push out the shaped section, causing it to fall into an accumulating device (not shown), leaving only the waste section 128 resting on the lower die 127. Meanwhile, the roller 135 of the waste tail separating device 133 is continuously rotated in the direction of arrow A135 by the motor 137 and the cam 142 is rotated in the direction of arrow A142. Thus, when the rod 143 enters the recess 142*a* on the surface of the cam 142, the lever 138 is urged downwardly by the spring 141. As a result, the rollers 135 are shifted from the position 135*a* shown in phantom lines, to the position 135 illustrated in solid lines, and act to move the waste tail 130 in the direction of arrow A130 while pressing downwardly against the tail 130 of the waste section 127. At this moment, since the front end portion 129 of the same waste section 127 is being moved in the direction of arrow A129 as a result of being gripped by the nipping devices 149, oppositely acting forces are simultaneously exerted upon the respective end portions of the waste section 128, causing the front end portion 129 and the rear end portion 130 of the waste section 127 to separate at the cuts 131*a* and 132*a*. The forward severed waste portion 129*a* is transferred to a waste receiver (not shown), while the severed waste tail 130*a* is removed from the machine by a belt conveyor 153.

When the waste tail separating operation has been completed, the rod 143 which has been located in the recess 142*a* of the contour of the cam 142 moves out of the recess as the result of rotation of the cam 142 in the direction of arrow A142. This raises the lever 138, so that the rollers 135 are again shifted from the position 135 shown in solid lines to the position 135*a* shown in phantom lines, that is, the rollers 135 are raised above the rear end portion of the lower die 127.

Figure 10A:
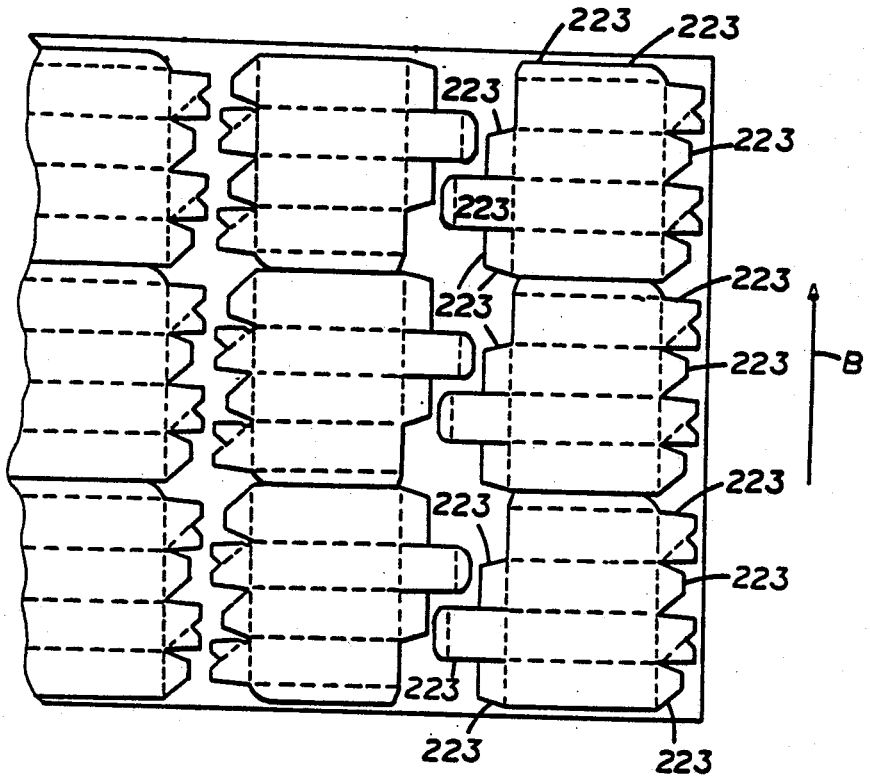
FIG. 10A illustrates a modification of the die cut arrangement shown in FIG. 10.
Figure 10:
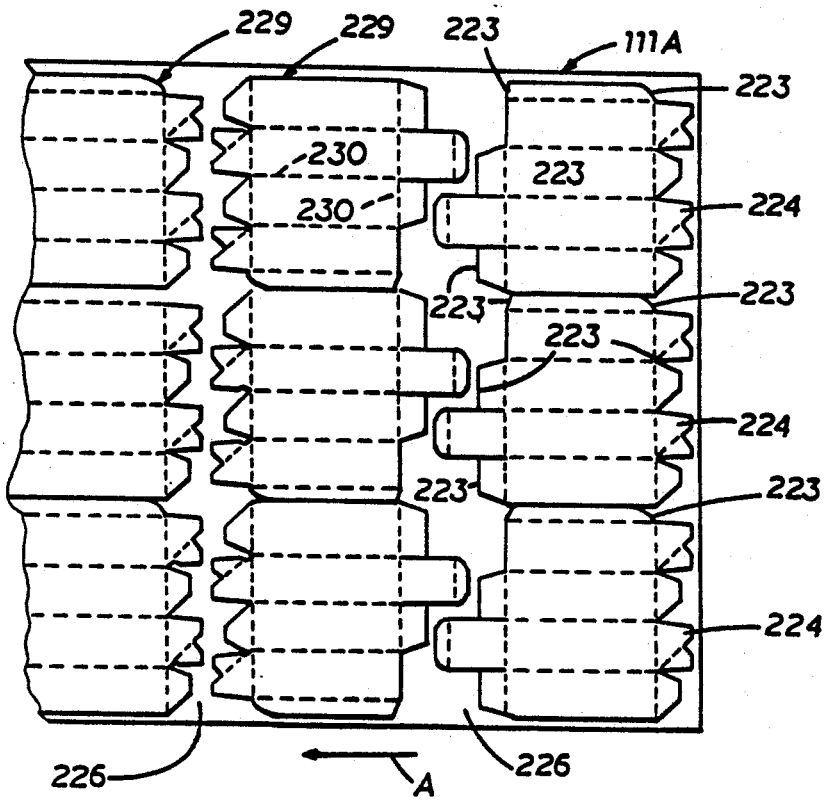
FIG. 10 is a fragmentary top view of a sheet of paper stock after it has been cut by the cutter-creaser and in the condition in which it is delivered to the separation station.
Figure 11:
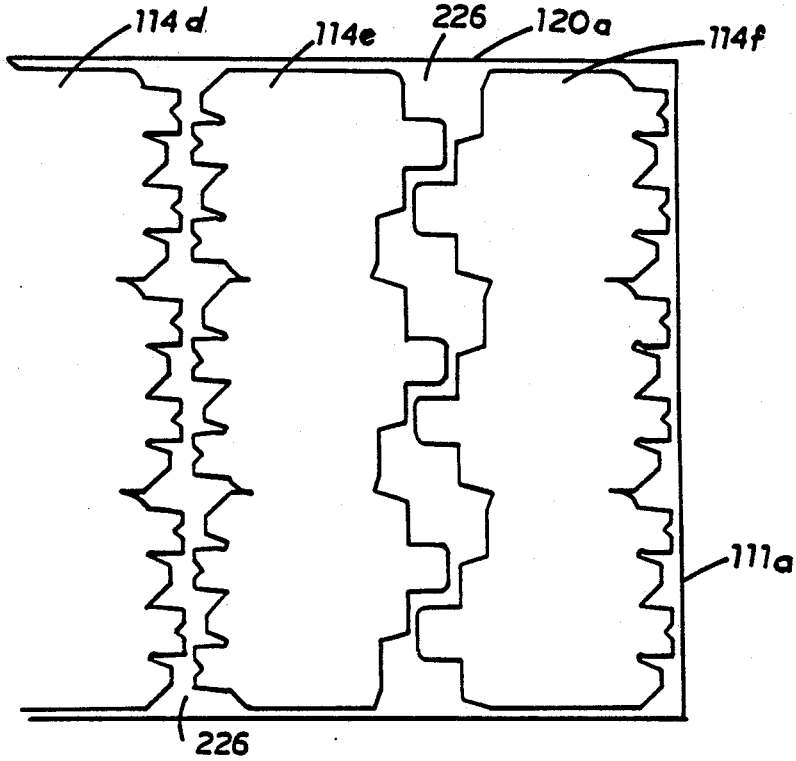
FIG. 11 is a fragmentary top view of the waste portion of the same sheet of paper stock illustrated in FIG. 10 after removal of the shaped portions.

If the waste tail removal mechanism illustrated in FIGS. 5 and 6 is applied to the shaped sections and die cut sheet illustrated in FIG. 10 it will be necessary to transport the sheet in the direction of the arrow B, illustrated in FIG. 10A. In this case, the bridges or nicks 223 would be arranged to reflect the difference in the direction of transport. However, they would function in the same manner, serving the same purpose. A possible pattern for the bridges 223 is shown in FIG. 10A.

The present invention should not be limited to the above-described embodiments, but, for instance, the waste tail cutting blades could be provided on the upper die 151 of the separating device 126 as shown by the broken lines 152 in FIG. 5 instead of being provided at the cutter-creaser station.

Figure 9:
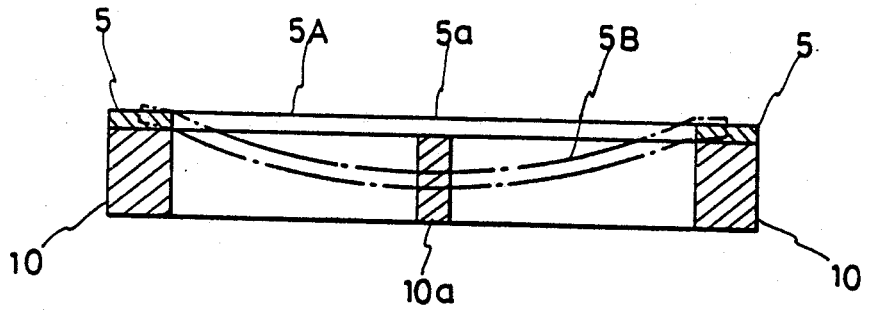
FIG. 9 (PRIOR ART)
FIG. 9 is an enlarged sectional view showing the position which may be assumed by the tail end portion during removal of the waste section from the lower die of the separating device of the prior art.

The waste tail removal mechanism which has been described makes it possible to smoothly remove the tail portion of the waste section from the top of the lower die without being caught by the lower die in the manner illustrated in FIG. 9.

We claim:

1. The improvement in the separation station of a machine for die cutting and separating shaped portions from a sheet of paper stock leaving a waste portion of minimal area, said separation station having upper and lower die members, said lower die member being the support for the paper stock during separation, said lower die having a plurality of contiguous die openings therein separated by narrow portions of said lower die, an upper die frame, said upper die member being secured to said frame in vertical alignment with the die openings in said lower die member, said upper and lower die members being cut simultaneously from a single panel of plywood veneer to provide accurately interfitting upper and lower dies and an upper die having a mass characterized by low inertia; said frame being rectangular, rods supporting said frame at each of its corners in parallel relationship to said lower die member, means connected to each of said rods for vertically reciprocating said rods, frame and upper die member such that the upper die members pass at least partially through the openings in said lower die member; synchronizing means connecting said rods for simultaneous reciprocation thereof through an identical stroke length whereby the parallel relationship of said upper and lower die members is always maintained for minimizing the length of time during each reciprocation cycle of the upper die that any portion thereof intersects the plane of the paper stock supported on the lower die member to increase the proportion of each operating cycle during which lineal movement of the paper stock to remove the waste portion of the stock and replace it with new stock from which shaped portions are to be removed can occur, at least substantial portions of said lower die between contiguous die openings being of a width such that said plywood veneer alone cannot withstand the vertical forces resulting from the upper die impacting against the shaped portions of the paper stock during the reciprocation of the upper die, means for reinforcing said portions of said lower die, said reinforcement means being a length of steel rule shaped to substantially follow the centerline of said die portions between contiguous die openings, one edge of said steel rule being bonded at all points throughout its entire length to the lower face of said portions of said lower die, the bond forming a continuous joint throughout the length of said steel rule with the steel rule depending from said lower die to form a T-shaped deflection resistant support for the waste portion of the paper stock thereabove.

2. A lower die for the separation station of a machine for separating the previously shaped sections from the waste portion of a sheet of paper stock which shaped sections remain attached to the waste portion by a few spaced partially cut, easily rupturable bridges, said lower die being formed from a panel of wood veneer and having adjacent plural openings therethrough separated from each other by at least one separator strip of a width such that it cannot support the impact type forces created by the upper die passing through the die openings to rupture the bridges and separate the shaped sections from the waste portion of the paper stock while the paper stock is supported on said lower die; means for reinforcing said separator strip, said reinforcing means being a length of steel rule shaped to seat beneath said separator strip, one edge of said steel rule being rigidly bonded throughout its length to the lower face of said separator strip with said steel rule in combination with said separator strip forming a structure of T-shaped cross section of which the steel rule is the depending leg for resisting the vertically acting bending loads imposed on said separator strip during the rupture of the bridges.

3. A lower die for a separator station as described in claim 1 wherein said separator strip can have portions of a width no greater than 5 mm.

4. A lower die for a separator station as described in claim 2 wherein said adjacent openings form the side edges of said separator strip said steel rule is so shaped that it is located substantially midway between the side edges which extends between adjacent openings of said separator strip.

5. A die for the separation station of a machine for separating the shaped sections from the waste portions of a previously cut sheet of paper stock, the shaped sections of which are still connected to the waste portions of the sheet of paper stock by spaced bridges of partially cut, rupturable paper, said bridges collectively having only sufficient strength to permit the sheet to be transported from a cutting station to a separation station without rupture of the bridges, said die comprising: a panel of plywood veneer having upper and lower faces and forming a lower die having formed therethrough plural die openings, an upper die having male die members of a size and shape to pass through said die openings with minimal clearance, the die openings in said lower die being separated from each other by at least one separator strip of a width such that said plywood cannot support forces of the magnitude generated by the upper die passing through said openings to rupture the bridges for effecting separation of the shaped sections from the waste portion of said paper stock while the paper stock is supported on said lower die; means for reinforcing said separator strip including a length of steel rule shaped to seat beneath said separator strip, one edge of said steel rule throughout its length being rigidly bonded to the lower face of and spaced from both side edges of said separator strip whereby said steel rule in combination with said strip forms a T-shaped section of which the steel rule constitutes the depending leg of the T-shape for resisting vertically acting bending loads.

6. A die for the separation station of a machine for separating the waste portions from the shaped portions of a previously cut sheet of paper stock, the shaped sections of which are still connected to the waste portions of the sheet of paper stock by a few, spaced, easily rupturable bridges of uncut paper, said bridges collectively having only sufficient strength to permit the sheet to be transported from a cutting station to a separation station without rupture of the bridges, said die comprising: a panel of plywood veneer having upper and lower surfaces and a plurality of contiguous openings therein of a size and shape just large enough to permit said shaped sections to be pushed therethrough as they are separated from the waste portion of the paper stock, said openings being separated by separator strips of the panel at least portions of which separator strips have a width such that said plywood alone cannot support the forces resulting from the upper die passing through said openings to rupture all of the bridges substantially simultaneously for effecting separation of the shaped sections from the waste portion of said paper stock; a reinforcement member for said separation strips comprising: lengths of steel creaser rule having one edge bonded throughout its length to the lower surface of each of said separator strips and depending therefrom to form a T-shaped reinforcement support for the paper stock above, which support is capable of withstanding the forces resulting from the upper die passing into the adjacent openings and rupturing all of the bridges substantially simultaneously to separate the shaped portions from the waste portion of the paper stock.

7. A die for a separation station as described in claim 8 wherein said panel has a thickness of approximately 19 mm and said separator strip has a minimum width of 5 mm, and said steel rule is of rectangular cross section with an edge thickness of approximately 2 mm and a height of approximately 18 mm.

8. A method of making a separating die for separating shaped portions from a sheet of paper stock which has been cut to outline the shaped portions and leave them connected to the waste portion of the paper stock by a few, easily rupturable bridges of uncut paper, including the steps of providing a panel of plywood veneer; cutting said panel to form simultaneously a plurality of upper dies and a lower die having a plurality of openings therethrough spaced apart by separator strips and shaped to permit one or more of the shaped portions of the paper stock to pass therethrough with only enough clearance to prevent contact between the edges of the shaped portions and walls of the openings thus formed, mounting on a frame the upper dies of the panel removed from said panel each of said upper die portions being in alignment with the opening from which it was removed, providing a length of steel rule, of generally rectangular cross section with a substantially greater dimension in one direction than the other bending the steel rule about an axis parallel to its greatest cross-sectional dimension to a shape which substantially corresponds to a line which is substantially midway between the edges of the separator strip to which it is to be secured while maintaining all portions of one edge of the separator strip in a single plane; placing said one edge of said steel rule against the bottom face of the separator and rigidly bonding said steel rule throughout its entire length to said bottom face of said panel whereby the steel rule depends from said panel and operates with the separator strip as a substantially unitary body to reinforce and stiffen said separator strip.

9. The method of making a separating die as described in claim 8 including the further steps of cutting said panel by a laser beam to minimize the width of the cut and to trace an intricate shape and wherein the steel rule is a length of such rule designed for use as a creaser die.

10. The method of making a separating die as described in claim 9 including the steps of selecting approximately 19 mm thick plywood for said panel and selecting steel rule having a vertical dimension of approximately 18 mm and a maximum thickness of 2 mm.

* * * * *